US010643766B1

(12) United States Patent
Farkas et al.

(10) Patent No.: US 10,643,766 B1
(45) Date of Patent: May 5, 2020

(54) DRAIN-ALIGNED CABLE AND METHOD FOR FORMING SAME

(71) Applicant: Dell Products L.P., Round Rock, TX (US)

(72) Inventors: Sandor Farkas, Round Rock, TX (US); Bhyrav M. Mutnury, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 16/166,403

(22) Filed: Oct. 22, 2018

(51) Int. Cl.
*H01B 11/20* (2006.01)
*H01B 11/18* (2006.01)
*H01B 11/10* (2006.01)

(52) U.S. Cl.
CPC ..... *H01B 11/203* (2013.01); *H01B 11/1091* (2013.01); *H01B 11/1808* (2013.01)

(58) Field of Classification Search
CPC combination set(s) only.
See application file for complete search history.

(56) References Cited

U.S. PATENT DOCUMENTS 2,583,026 A * 1/1952 Swift ..... H01B 7/188 174/117 R
3,999,003 A * 12/1976 Chevrolet ..... B05D 1/14 174/23 R
4,468,089 A * 8/1984 Brorein ..... G02B 6/4403 156/53
4,488,125 A * 12/1984 Gentry ..... H01B 7/0823 174/115
4,492,815 A * 1/1985 Maros ..... H01B 7/0823 174/115
4,588,852 A * 5/1986 Fetterolf ..... H01B 11/203 174/103
4,596,897 A * 6/1986 Gruhn ..... H01B 11/1091 174/36
4,599,483 A * 7/1986 Kuhn ..... H01B 11/08 174/103
4,883,922 A * 11/1989 Yokota ..... H01L 39/143 505/211
4,943,688 A * 7/1990 VanDeusen ..... H01B 7/1895 174/103
5,119,046 A * 6/1992 Kozlowski, Jr. ..... H01B 7/363 174/112

(Continued)

*Primary Examiner* — William H. Mayo, III
*Assistant Examiner* — Krystal Robinson
(74) *Attorney, Agent, or Firm* — Jackson Walker L.L.P.

(57) ABSTRACT

A dual-axial cable may include adjacent and substantially parallel first and second wires, each wire formed from an electrical conductor surrounded by a respective first and second electrical insulator having a lengthwise flat face outward side and having respective first and second inward sides of an interlocking structure, the first and second inward sides of the interlocking structure of the first and second electrical insulators mutually engaging to prevent a relative transverse displacement of the first and second wires and maintaining planar alignment of the flat face and electrical conductor of the first and second wires and to maintain the flat faces parallel to one another. The dual-axial cable may also include first and second drain conductors formed respectively on the flat faces of the first and second electrical insulators and running adjacent and substantially parallel to the first and second electrical conductors.

23 Claims, 13 Drawing Sheets

(56) References Cited

U.S. PATENT DOCUMENTS 5,486,649 A * 1/1996 Gareis ..... H01B 11/1016 174/10
5,696,352 A * 12/1997 Kourimsky ..... H01B 7/0009 174/126.3
5,872,334 A * 2/1999 Trazyik ..... H01B 11/1091 174/107
5,883,334 A * 3/1999 Newmoyer ..... H01B 11/02 174/113 C
5,990,419 A * 11/1999 Bogese, II ..... H01B 7/184 174/113 AS
6,444,902 B1 * 9/2002 Tsao ..... H01B 7/0861 174/113 R
6,803,518 B2 * 10/2004 Chang ..... H01B 11/002 174/113 R
6,967,289 B2 * 11/2005 Goto ..... H01B 7/0009 174/129 R
7,462,782 B2 * 12/2008 Clark ..... H01B 11/002 174/110 R
7,479,597 B1 * 1/2009 Cases ..... H01B 7/0009 174/115
7,479,601 B1 * 1/2009 Cases ..... H01B 11/203 174/102 R
7,795,539 B2 * 9/2010 Thuot ..... H01B 7/0275 174/110 R
7,964,797 B2 * 6/2011 Clark ..... H01B 7/184 174/110 R
9,123,452 B2 * 9/2015 Sugiyama ..... H01B 7/0823
9,355,755 B2 * 5/2016 Gundel ..... H01B 7/0838
9,660,318 B2 * 5/2017 Sugiyama ..... H01B 7/0823
9,741,465 B2 * 8/2017 Gross ..... H01B 7/00
10,283,240 B1 * 5/2019 Shanbhag ..... H01B 11/1834
10,368,437 B2 * 7/2019 Farkas ..... H05K 1/0219
2004/0256139 A1 * 12/2004 Clark ..... H01B 11/002 174/110 R
2009/0229850 A1 * 9/2009 Cases ..... H01B 11/20 174/102 R
2010/0294557 A1 * 11/2010 Cases ..... H01B 11/203 174/350
2011/0083877 A1 * 4/2011 Sugiyama ..... H01B 7/0823 174/115
2011/0127062 A1 * 6/2011 Cases ..... H01B 11/1016 174/103
2011/0290524 A1 * 12/2011 Lingambudi ..... H01B 11/203 174/102 R
2013/0168149 A1 * 7/2013 Gundel ..... H01B 7/0861 174/350
2014/0202751 A1 * 7/2014 Bugg ..... H01R 9/032 174/261
2015/0144391 A1 * 5/2015 Havermann ..... H01R 12/53 174/262
2015/0170794 A1 * 6/2015 Mutnury ..... H01B 7/17 174/105 R
2016/0036112 A1 * 2/2016 Sugiyama ..... H01B 7/0823 333/12
2016/0233006 A1 * 8/2016 Chamberlain ..... H01B 7/0892
2016/0372235 A1 * 12/2016 Sugiyama ..... H01B 11/002
2018/0102204 A1 * 4/2018 Li ..... H01B 7/17
2018/0366243 A1 * 12/2018 Farkas ..... H01B 11/20

* cited by examiner

DRAIN-ALIGNED CABLE AND METHOD FOR FORMING SAME

TECHNICAL FIELD

The present disclosure relates in general to information handling systems, and more particularly to a drain-aligned cable and a method for forming same.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

In many applications, one or multiple information handling systems configured as servers may be installed within a single chassis, housing, enclosure, or rack. Communication between components internal to the servers, as well as communication between two or more servers and/or between enclosures, is often accomplished via communication cables. Within a server, for example, cables may electronically connect one or more printed circuit boards (PCBs). Cables provide a lower loss mode for signal propagation compared to PCBs which makes cables a frequent design choice. Thus, communication cables are an integral part of conventional server design.

Existing single-drain and dual-drain dual-axial cables are often satisfactory to support current signal/data transfer speeds within a conventional information handling system. However, the signal/data speeds expected within newer generations of information handling systems are increasing significantly, as such speeds often double with each successive generation. Higher signal speeds result in a corresponding increase in signal integrity sensitivity to parasitic effects. Peripheral Component Interconnect Express (PCIe) communication in current generations of servers is at 16 Gbps (gigabits per second). In future generations, PCIe communication is expected to be at 32 Gbps speeds. Subtle effects that do not impact the signal performance of conventionally utilized dual-axial cables may become significant at next-generation signal speeds.

SUMMARY

In accordance with the teachings of the present disclosure, the disadvantages and problems associated with construction of electrical cables may be substantially reduced or eliminated.

In accordance with embodiments of the present disclosure, a dual-axial cable may include adjacent and substantially parallel first and second wires, each wire formed from an electrical conductor surrounded by a respective first and second electrical insulator having a lengthwise drain alignment groove on an outward side and having respective first and second inward sides of an interlocking structure, the first and second inward sides of the interlocking structure of the first and second electrical insulators mutually engaging to prevent a relative transverse displacement of the first and second wires and maintaining planar alignment of the lengthwise drain alignment grooves and electrical conductors of the first and second wires. The dual-axial cable may also include first and second drain conductors received respectively in the lengthwise drain alignment grooves of the first and second electrical insulators and running adjacent and substantially parallel to the first and second electrical conductors, wherein the lengthwise drain alignment grooves are sized and shaped to have three sides for receiving the first and second drain conductors.

In accordance with these and other embodiments of the present disclosure, a method may include forming first and second wires respectively by surrounding a length of an electrical conductor with a respective one of a first and second electrical insulator having a lengthwise drain alignment groove on an outward side and having respective first and second inward sides of an interlocking structure. The method may also include mutually engaging the first and second inward sides of the interlocking structure of the first and second electrical insulators to prevent a relative transverse displacement of the first and second wires and maintaining planar alignment of the lengthwise drain alignment grooves and electrical conductors of the first and second wires, wherein the first and second wires are adjacent and substantially parallel to each other. The method may further include inserting first and second drain conductors respectively in the lengthwise drain alignment grooves of the first and second electrical insulators, the first and second drain conductors running adjacent and substantially parallel to the first and second electrical conductors, respectively, forming a dual-axial cable. The lengthwise drain alignment grooves may be sized and shaped for receiving the first and second drain conductors.

In accordance with these and other embodiments of the present disclosure, a dual-axial cable may include adjacent and substantially parallel first and second wires, each wire formed from an electrical conductor surrounded by a respective first and second electrical insulator having a lengthwise flat face outward side and having respective first and second inward sides of an interlocking structure, the first and second inward sides of the interlocking structure of the first and second electrical insulators mutually engaging to prevent a relative transverse displacement of the first and second wires and maintaining planar alignment of the flat face and electrical conductor of the first and second wires and to maintain the flat faces parallel to one another. The dual-axial cable may also include first and second drain conductors formed respectively on the flat faces of the first and second electrical insulators and running adjacent and substantially parallel to the first and second electrical conductors.

In accordance with these and other embodiments of the present disclosure, a method may include forming first and second wires respectively by surrounding a length of an electrical conductor with a respective one of a first and second electrical insulator having a flat face on an outward side and having respective first and second inward sides of an interlocking structure. The method may also include mutually engaging the first and second inward sides of the interlocking structure of the first and second electrical insulators to prevent a relative transverse displacement of the first and second wires and maintaining planar alignment of the flat faces and electrical conductors of the first and second wires and to maintain the flat faces parallel to one another, wherein the first and second wires are adjacent and substantially parallel to each other. The method may further include forming first and second drain conductors respectively on the flat faces of the first and second electrical insulators, the first and second drain conductors running adjacent and substantially parallel to the first and second electrical conductors, respectively, forming a dual-axial cable.

Technical advantages of the present disclosure may be readily apparent to one skilled in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Preferred embodiments and their advantages are best understood by reference to FIGS. 1 through 10, wherein like numbers are used to indicate like and corresponding parts.

For the purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system may be a personal computer, a PDA, a consumer electronic device, a network storage device, or any other suitable device and may vary in size, shape, performance, functionality, and price. The information handling system may include memory, one or more processing resources such as a central processing unit (CPU) or hardware or software control logic. Additional components of the information handling system may include one or more storage devices, one or more communications ports for communicating with external devices as well as various input and output (I/O) devices, such as a keyboard, a mouse, and a video display. The information handling system may also include one or more buses operable to transmit communication between the various hardware components.

For the purposes of this disclosure, computer-readable media may include any instrumentality or aggregation of instrumentalities that may retain data and/or instructions for a period of time. Computer-readable media may include, without limitation, storage media such as a direct access storage device (e.g., a hard disk drive or floppy disk), a sequential access storage device (e.g., a tape disk drive), compact disk, CD-ROM, DVD, random access memory (RAM), read-only memory (ROM), electrically erasable programmable read-only memory (EEPROM), and/or flash memory; as well as communications media such as wires, optical fibers, microwaves, radio waves, and other electromagnetic and/or optical carriers; and/or any combination of the foregoing.

For the purposes of this disclosure, information handling resources may broadly refer to any component system, device or apparatus of an information handling system, including without limitation processors, buses, memories, I/O devices and/or interfaces, storage resources, network interfaces, motherboards, integrated circuit packages; electro-mechanical devices (e.g., air movers), displays, and power supplies.

Figure 1A:
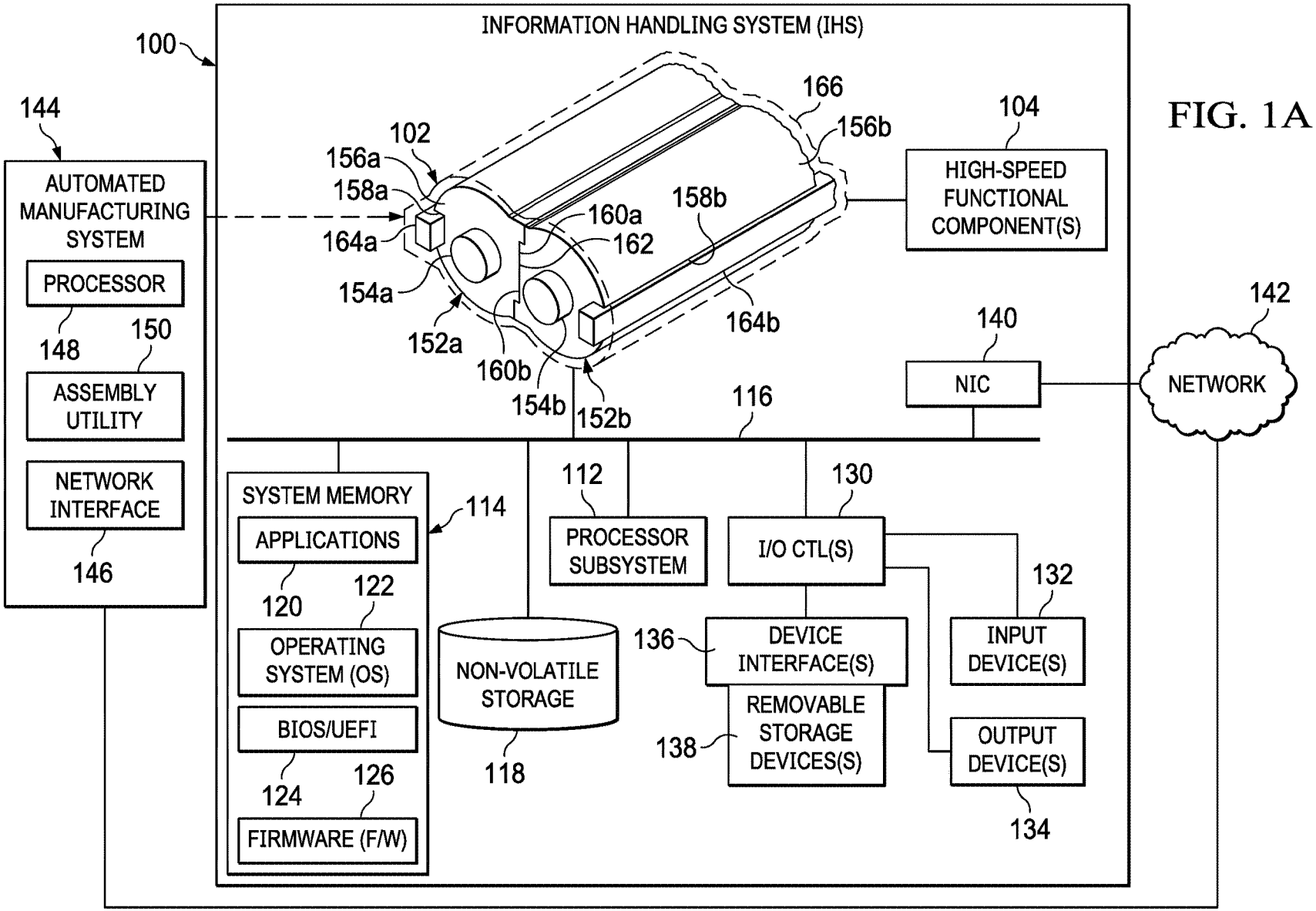
FIG. 1A illustrates a block diagram of an example information handling system, in accordance with embodiments of the present disclosure.

FIG. 1A illustrates a block diagram of an example information handling system 100, in accordance with embodiments of the present disclosure. As shown in FIG. 1A, information handling system 100 may have a dual-drain cable 102 with mechanical and electrical dual-axial properties that support next generation (and beyond) differential signaling speeds to high-speed functional component(s) 104.

Also as shown in FIG. 1A, information handling system 100 may include a processor subsystem 112 coupled to a system memory 114 via a system interconnect 116, which may include dual-drain cable 102. In some embodiments, system interconnect 116 may be interchangeably referred to as a system bus. System interconnect 116 may also be coupled to non-volatile storage, e.g., non-volatile random-access memory (NVRAM) storage 118, within which may be stored one or more software and/or firmware modules and one or more sets of data that may be utilized during operations of information handling system 100. These one or more software and/or firmware modules may be loaded into system memory 114 during operation of information handling system 100. Specifically, in some embodiments, system memory 114 may include therein a plurality of such modules, including one or more of application(s) 120, operating systems (OSes) 122, basic input/output system (BIOS) or Uniform Extensible Firmware Interface (UEFI) 124, and/or firmware (F/W) 126. These software and/or firmware modules may have varying functionality when their corresponding program code is executed by processor subsystem 112 or secondary processing devices within information handling system 100. For example, application(s) 120 may include a word processing application, a presentation application, a management station application, and/or one or more other applications.

Information handling system 100 may further include one or more input/output (I/O) controllers 130, which may support connections by and processing of signals from one or more connected input device(s) 132, such as a keyboard, mouse, touch screen, and/or microphone. I/O controllers 130 may also support connection to and forwarding of output signals to one or more connected output devices 134, such as a monitor, display device, and/or audio speaker(s). Additionally, in some embodiments, one or more device interfaces 136, such as an optical reader, a universal serial bus (USB), a card reader, a Personal Computer Memory Card International Association (PCMCIA) slot, and/or high-definition multimedia interface (HDMI), may be associated with information handling system 100. Device interface(s) 136 may be utilized to enable data to be read from or stored to corresponding removable storage device(s) 138, such as, for example, a compact disk (CD), a digital versatile disk (DVD), a flash drive, and/or a flash memory card. In some embodiments, device interface(s) 136 may further include general purpose I/O interfaces such as, for example, inter-integrated circuit (I2C), system management bus (SMB), and/or peripheral component interconnect (PCI) buses.

Information handling system 100 may also include network interface controller (NIC) 140. NIC 140 may enable information handling system 100 and/or components within information handling system 100 to communicate and/or interface with other devices, services, and/or components that are located external to information handling system 100. These devices, services, and components may interface with information handling system 100 via an external network, such as example network 142, using one or more communication protocols, such as, for example, Transport Control Protocol/Internet protocol (TCP/IP) and network block device (NBD) protocol. Network 142 may be a local area network, a wide area network, a personal area network, and/or any other suitable network, and connection to and/or between network 142 and information handling system 100 may be wired, wireless, or a combination thereof. For purposes of clarity and exposition, network 142 is shown in FIG. 1A as single collective component connected to automated manufacturing system 144 that communicates via network interface 146. However, it is understood that network 142 may itself comprise one or more information handling systems and infrastructure for communicatively coupling together such one or more information handling systems.

An automated manufacturing system 144 may control fabrication and assembly of dual-drain cable 102. Processor 148 of automated manufacturing system 144 may execute assembly utility 150 to form dual-drain cable 102 that includes adjacent and substantially parallel first and second wires 152*a* and 152*b*. Each wire 152*a*, 152*b* may be formed with a respective electrical conductor 154*a*, 154*b* surrounded by a respective first and second electrical insulator 156*a*, 156*b* having a respective lengthwise drain alignment groove 158*a*, 158*b* on its outward side and having respective first and second inward sides 160*a*, 160*b* of interlocking structure 162. First and second inward sides 160*a*, 160*b* of interlocking structure 162 of first and second electrical insulators 156*a*, 156*b* may mutually engage to prevent relative transverse displacement of first and second wires 152*a*, 152*b*. Interlocking structure 162 may maintain planar alignment of lengthwise drain alignment grooves 158*a*, 158*b* and electrical conductors 154*a*, 154*b* of first and second wires 152*a*, 152*b*. First and second drain conductors 164*a*, 164*b* may be received respectively in lengthwise drain alignment grooves 158*a*, 158*b* of first and second electrical insulators 156*a*, 156*b* and run adjacent and substantially parallel to first and second electrical conductors 152*a*, 152*b*. A shield 166 of foil conductive material may be helically wrapped around an exterior perimeter of the assembly of first and second wires 152*a*, 152*b* and first and second drain conductors 164*a*, 164*b*.

Dual-drain cable 102 may be used for short to medium reach (e.g., less than 10-20 meters) in standards, including, but not limited to, Serial Attached Small Computer System Interface (SAS), InfiniBand, Serial Advanced Technology Attachment (SATA), Peripheral Component Interconnect Express (PCIe), Double Speed Fibre Channel, Synchronous Optical Networking (SONET), Synchronous Digital Hierarchy (SDH), and/or 10 Gigabit Ethernet (10 GbE). The present disclosure may provide an approach to constructing dual-axial cables that may ensure that the electrical performance is not compromised by displacement of drain conductors 164*a*, 164*b*. Maintaining electrical performance allows expected higher communication speeds for use in PCIe fifth generation (Gen5) and SAS 4.0 solutions in sixteenth generation (16G) and beyond.

Figure 1B:
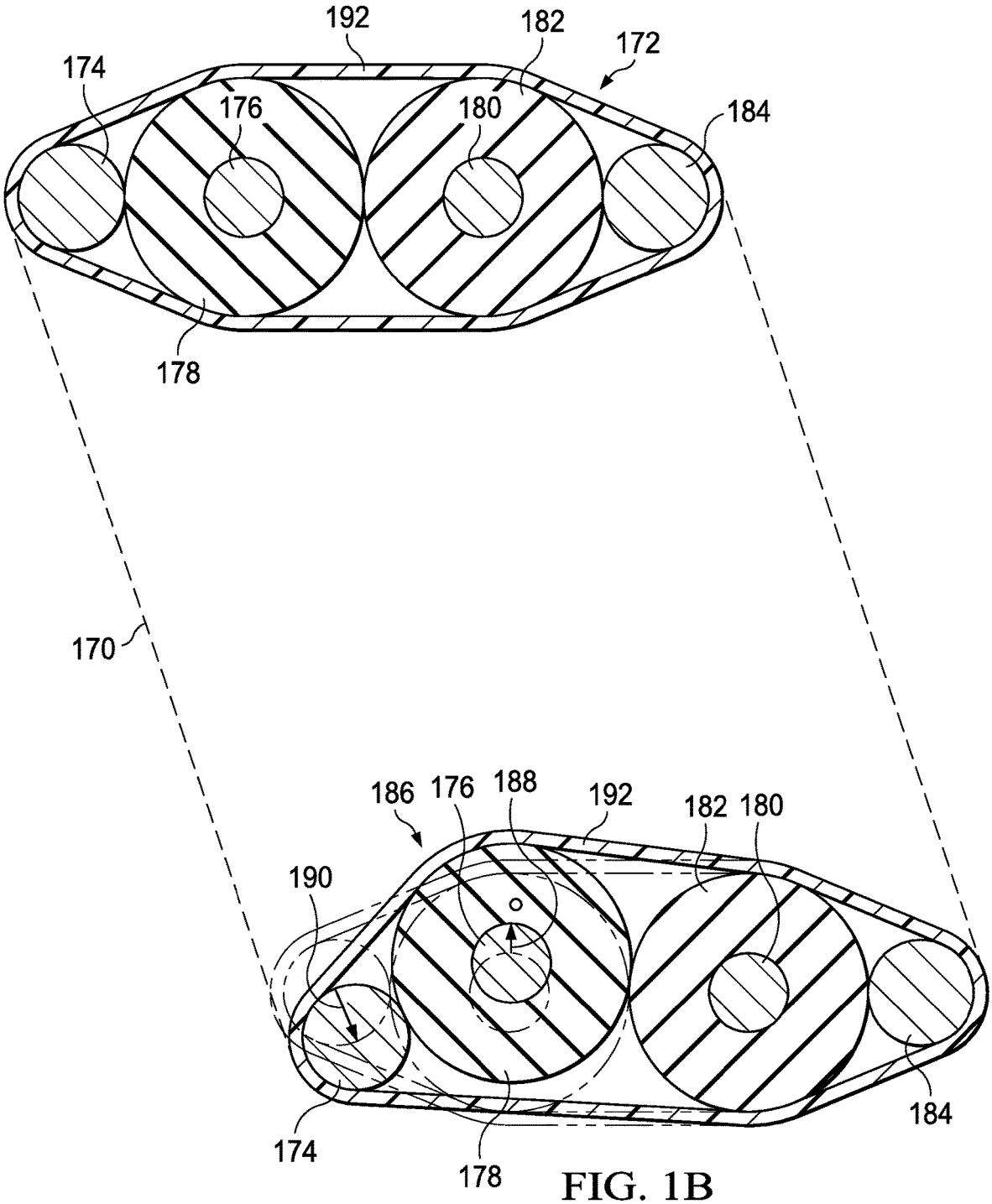
FIG. 1B (PRIOR ART)
FIG. 1B illustrates a cross-sectional view of two ends of a dual-axial cable, as is known in the art.

FIG. 1B illustrates a cross-sectional view of two ends 172, 186 of a dual-axial cable 170, as is known in the art. As shown in FIG. 1B, dual-axial cable 170 may have a first end manufactured with left drain conductor 174, left signal conductor 176 of left differential signal wire 178, right signal conductor 180 of right signal wire 182, and right drain conductor 184, which, in an ideal case, are all in planar alignment with one another. Each of left and right drain conductors 174, 184 and left and right signal wires 178, 182 may have a respective circular cross section that may contact only at a small areas. Thus, left and right drain conductors 174, 184 and left and right signal wires 178, 182 may twist or otherwise move relative to each other during assembly at a second end 186 of dual-axial cable 170. At second end 186, left signal wire 178 may include a relative transverse displacement 188 upward from right signal wire 182, creating a nonplanar alignment with the combination of right signal wire 182 and right drain conductor 184. In response to the relative transverse displacement 188, left drain wire 174 may include a relative displacement 190 downward and to the right. Relative displacement 190 may take left drain wire 174 out of planar alignment with any combination of left and right signal wires 178, 182 and right drain conductor 184. For example, an outer layer 192 that provides electrical shielding and protection to the dual-axial cable 170 may urge the left drain conductor 174 with relative displacement 190. Electrical performance may be degraded when left drain conductor 174, left signal conductor 176, right signal conductor 180, and right drain conductor 184 are not all in planar alignment.

Figure 2:
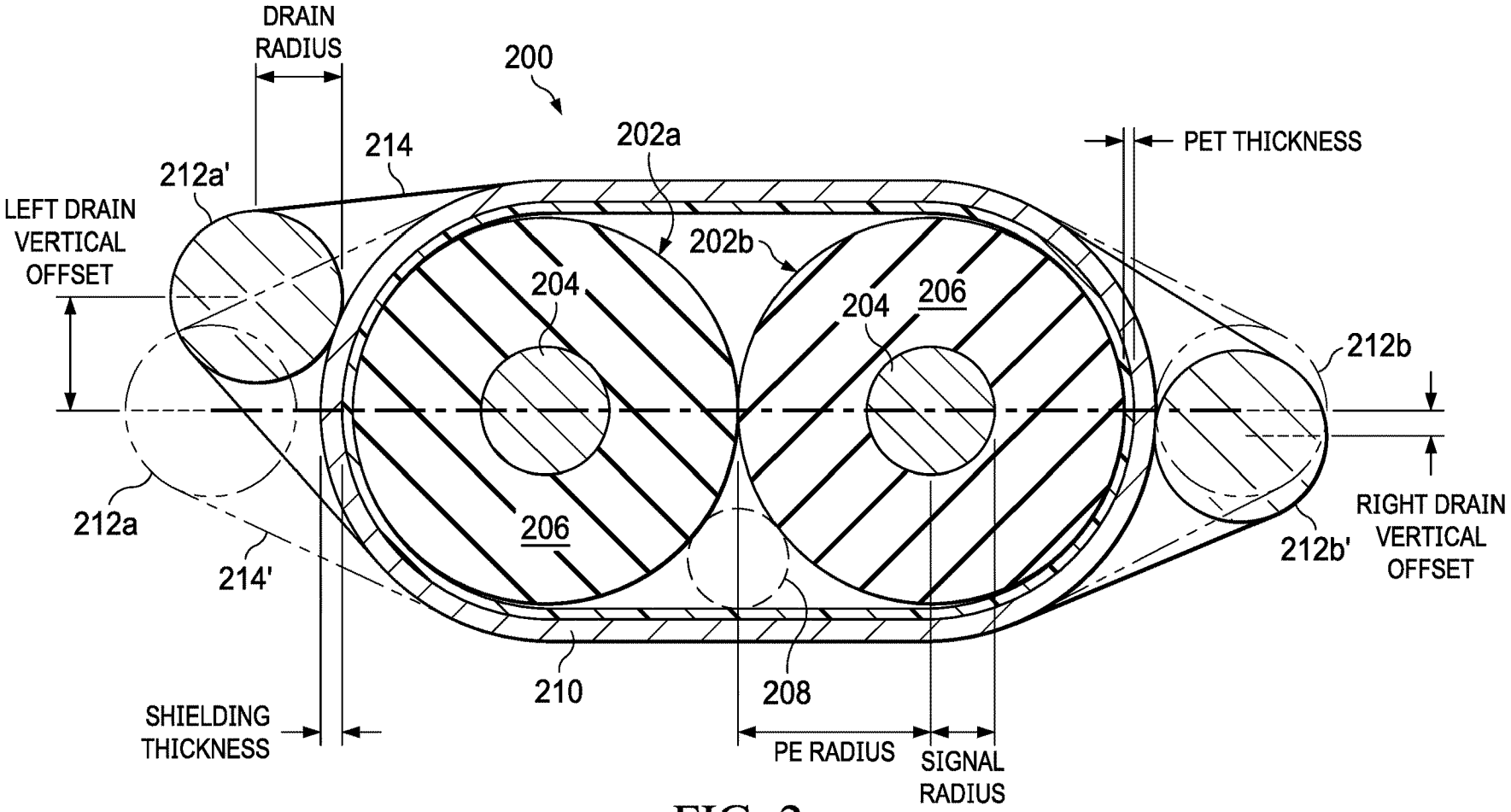
FIG. 2 (PRIOR ART)
FIG. 2 illustrates a cross-sectional view of a dual-axial cable, as is known in the art.

FIG. 2 illustrates a cross-sectional view of a dual-axial cable 200, as is known in the art. As shown in FIG. 2, dual-axial cable 200 may have wires 202*a*, 202*b* each including central conductor wire 204 surrounded by cylindrical insulator 206. In one embodiment, central drain wire 208 (shown in dashed line) represents one known approach to improve shielding when assembled within a spiral wrap shield 210 as a center-drain dual-axial cable. However, a center-drain dual-axial cable may have a resonance or suck-out effect due to the spiral wrapping of shield 210 around the assembly of two conductor wires 202*a*, 202*b* and central drain wire 208. The spiral wrap shield 210 may create a periodic return path discontinuity resulting in a resonance, which may degrade performance, as described with respect to FIG. 3, below.

Dual-drain dual-axial cables, represented in FIG. 2 by aligned drain wires 212*a*, 212*b* (shown in dashed lines) and without central drain wire 208, may not have resonance and thus may support very high speeds and long cable lengths. Helical foil wrap 214 may be applied during manufacturing. A polyester (e.g., polyethylene terephthalate (PET)) or other plastic sheath (not shown) may cover the entire assembly. However, dual-drain dual-axial cables may also have a disadvantage which may cause performance issues at high speeds. The location of the two drain wires 212*a*, 212*b* may be offset by a few mils, depending on the spiral wrapping and depending on the cable formation, such as helical foil wrap 214'(shown in dashed lines). For example, left drain wire 212*a'* may be upwardly offset and right drain wire 212*b'* may be downwardly offset from the ideal positions of left and right drain wires 212*a*, 212*b*.

Figure 3:
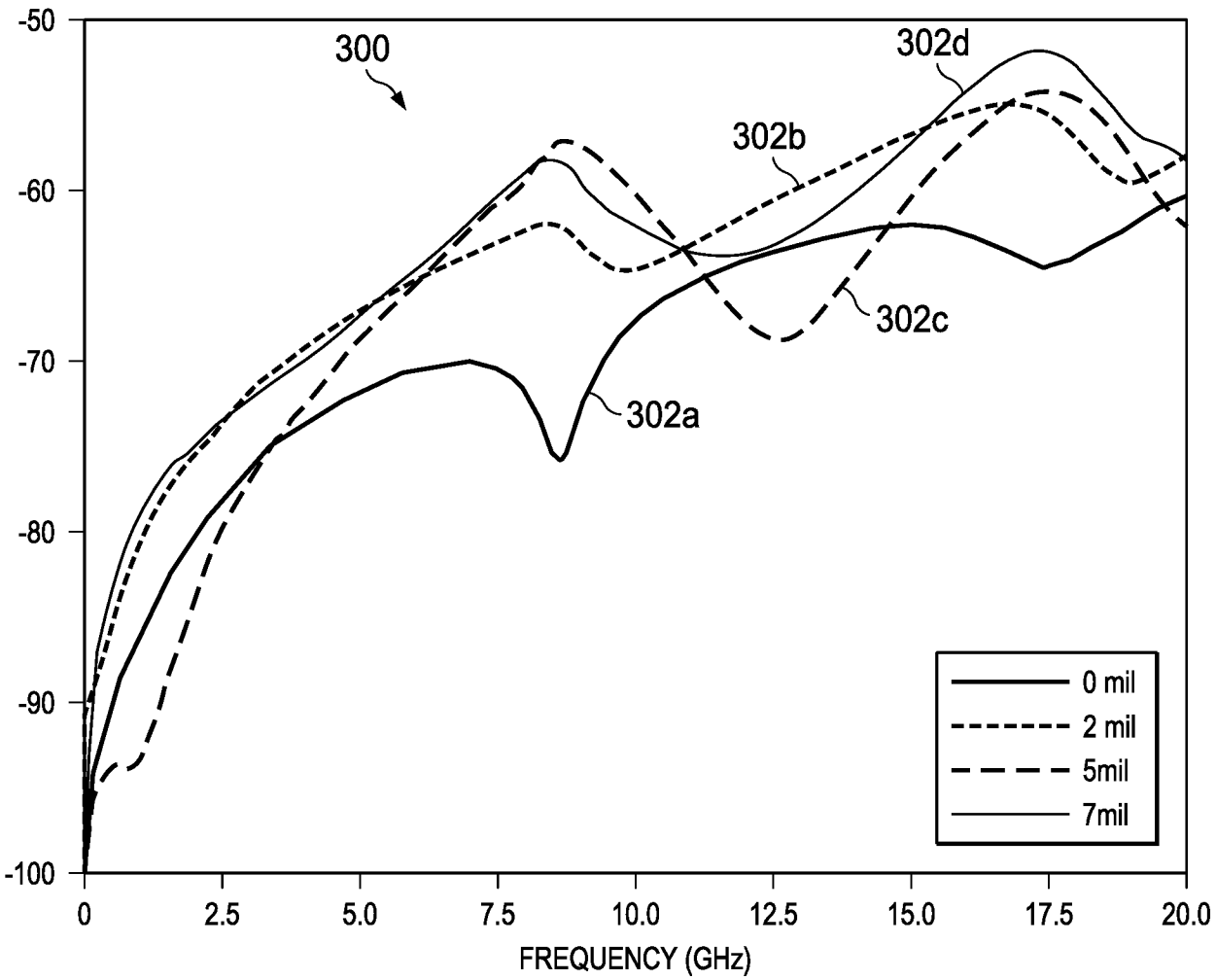
FIG. 3 (PRIOR ART)
FIG. 3 illustrates a graphical representation illustrating signal loss versus frequency plots for a dual-drain, dual-axial cable, as is known in the art.

FIG. 3 illustrates a graphical representation 300 illustrating signal loss versus frequency plots 302*a-d* for a dual-drain, dual-axial cable, as is known in the art. Such plots illustrate impedance changes that may result from an offset between drain wires for a conventional dual-drain, dual-axial cable. A plot 302*a* for an aligned drain wire ("0 mil") may generally have lower impedance drain wires with 2, 5 and 7 mils of offset, as shown in impedance plots 302*b-d*, respectively. Cable impedance may be highly related to propagation delay and mode conversion impacts. Any mismatch in propagation delay may result in resonance at high speeds. Mismatch in propagation delay may also result in common-mode conversion from a differential mode which may increase crosstalk. Conventional dual-drain, dual-axial cables may have degraded performance represented by plots 302*b-d* in addition to a subset that are manufactured with 0 mil offset as given by impedance plot 302*a*. A conventional dual-drain, dual-axial cable may not maintain a uniform performance across lengths of cable or even between specimens of cable. Thus, a conventional dual-drain, dual-axial cable may be inadequate for higher communication speed requirements. By contrast, a dual-drain cable manufactured according to aspects of the present innovation may avoid having non-zero offsets from the ideal planar alignment. Without any drain wires in a manufacturing sample that deviate with non-zero offsets such as shown in impedance plots 302*b-d*, a dual-drain-cable according to the present disclosure may be adequate for higher communication speed requirements. Dual-drain cables that maintain drain wires with ideal 0-mil offsets may be a significant improvement over conventional dual-drain, dual-axial cables.

Figure 4A:
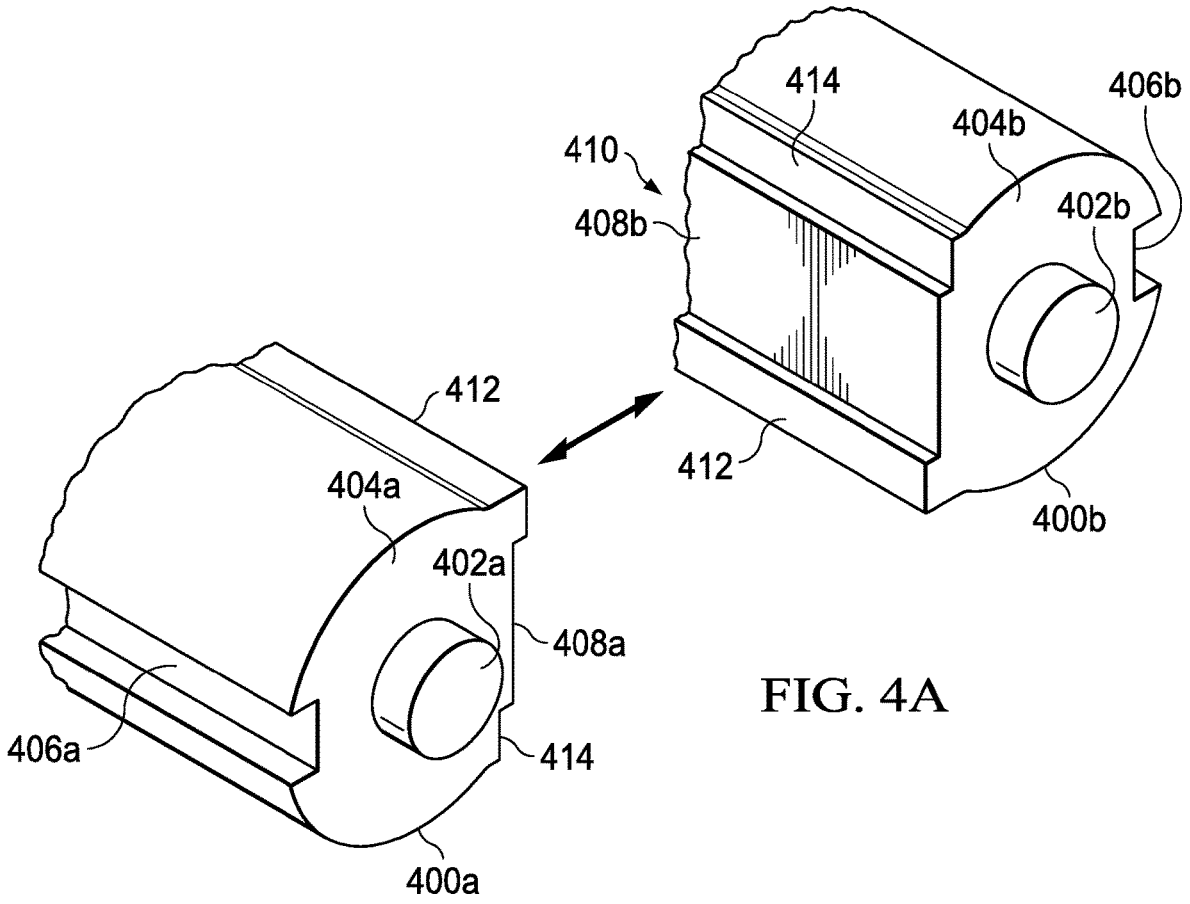
FIG. 4A illustrates a left-side perspective view illustrating example first and second wires of a dual-axial cable which are disassembled and identically formed, in accordance with embodiments of the present disclosure.
Figure 4B:
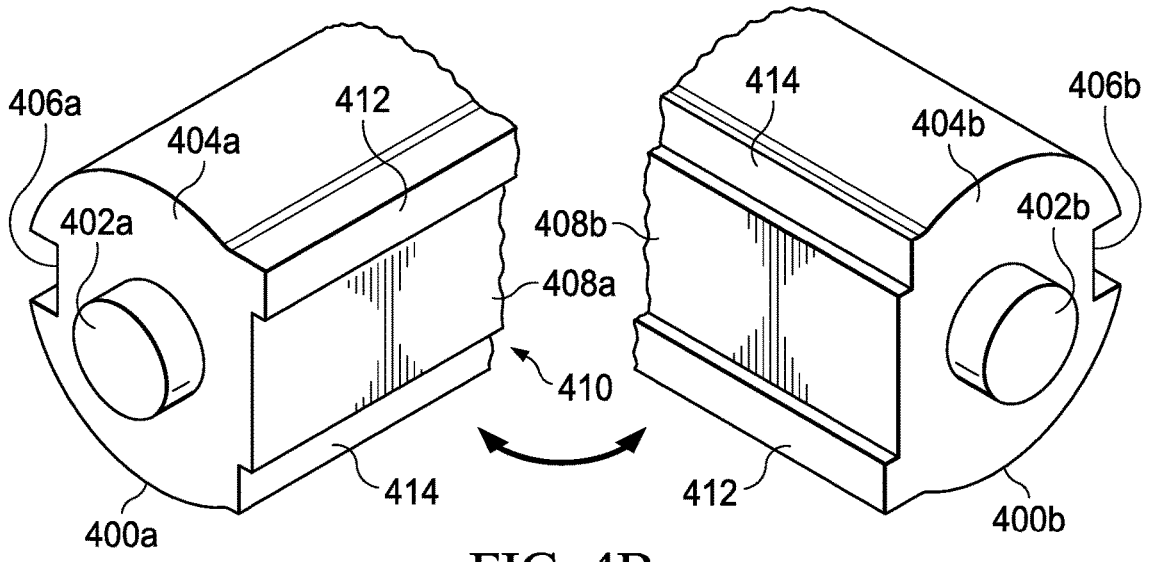
FIG. 4B illustrates a center perspective view illustrating the example first and second wires shown in FIG. 4A, in accordance with embodiments of the present disclosure.

FIG. 4A illustrates a left-side perspective view illustrating example first and second wires 400*a*, 400*b* of a dual-axial cable which are which disassembled and identically formed, in accordance with embodiments of the present disclosure, while FIG. 4B illustrates a center perspective view illustrating the example first and second wires 400*a*, 400*b* shown in FIG. 4A, in accordance with embodiments of the present disclosure. As shown in FIGS. 4A and 4B, first and second wires 400*a*, 400*b* may be identically formed with respective electrical conductors 402*a*, 402*b* surrounded by respective first and second electrical insulators 404*a*, 404*b*. First and second electrical insulators 404*a*, 404*b* may each have a lengthwise drain alignment groove 406*a*, 406*b* on an outward side. First and second electrical insulators 404*a*, 404*b* may have respective first and second inward sides 408*a*, 408*b* of interlocking structure 410. Second wire 400*b* may be rotated 180° about a longitudinal axis relative to the first wire 400*a* to orient second inward side 408*b* into contacting opposition with first inward side 408*a*. First and second inward sides 408*a*, 408*b* may include male and female interlocking surfaces 412, 414 symmetrically spaced about a midpoint.

Figure 4C:
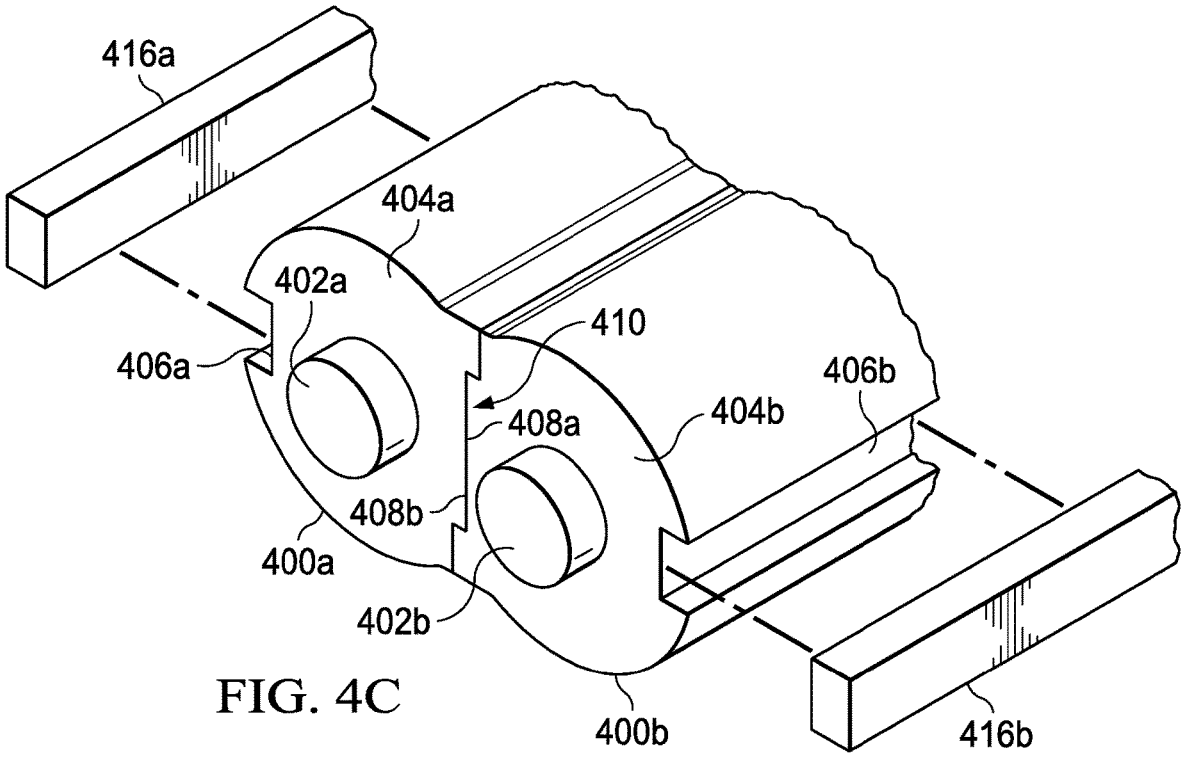
FIG. 4C illustrates a right-side perspective view illustrating the example first and second wires shown in FIGS. 4A and 4B interlocked and with disassembled drain conductors, in accordance with embodiments of the present disclosure.
Figure 4D:
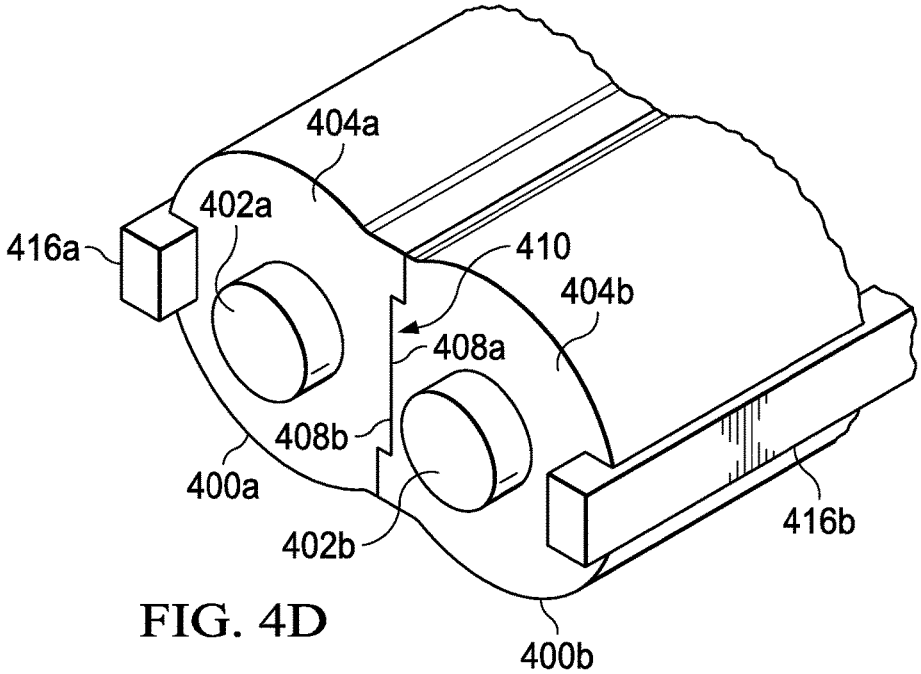
FIG. 4D illustrates a right-side perspective view illustrating the example first and second wires shown in FIG. 4C assembled with drain conductors, in accordance with embodiments of the present disclosure.

FIG. 4C illustrates a right-side perspective view illustrating example first and second wires 400*a*, 400*b* interlocked and with disassembled drain conductors 416*a*, 416*b*, in accordance with embodiments of the present disclosure, while FIG. 4D illustrates a right-side perspective view illustrating example first and second wires 400*a*, 400*b* assembled with drain conductors 416*a*, 416*b*, in accordance with embodiments of the present disclosure. As shown in FIGS. 4C and 4D, first and second inward sides 408*a*, 408*b* of interlocking structure 410 of first and second electrical insulators 404*a*, 404*b* may mutually engage to prevent a relative transverse displacement of first and second wires 400*a*, 400*b*. Thus, interlocking structure 410 may maintain planar alignment of lengthwise (e.g., lengthwise in a direction parallel to an axis through the center of electrical conductors 402*a*, 402*b*) to the drain alignment grooves 406*a*, 406*b* and electrical conductors 402*a*, 402*b* of the first and second wires 400*a*, 400*b*. As shown in FIG. 4D, first and second drain conductors 416*a*, 416*b* may be adjacent and substantially parallel to first and second wires 400*a*, 400*b* and may be received in respective drain alignment grooves 406*a*, 406*b*.

As depicted in FIG. 4D, lengthwise drain alignment grooves 406*a*, 406*b* may include three flat sides, so as to receive first and second drain conductors 416*a*, 416*b* which may be rectangular in shape in a cross section of first and second drain conductors 416*a*, 416*b* taken in a plane perpendicular to the length of lengthwise drain alignment grooves 406*a*, 406*b* (e.g., the cross section taken in a plane perpendicular to an axis through the center of electrical conductors 402*a*, 402*b*). Although FIGS. 4A-4D depict lengthwise drain alignment grooves 406*a*, 406*b* as rectangular in shape in a cross section of first and second drain conductors 416*a*, 416*b* taken in a plane perpendicular to the length of lengthwise drain alignment grooves 406*a*, 406*b*, in some embodiments, such lengthwise drain alignment grooves 406*a*, 406*b* may be of another shape (e.g., semicircular as shown in FIG. 5).

In the construction illustrated by FIG. 4D, while some return current may flow on a shield (e.g., shield 166 shown in FIG. 1A), the largest portion of such return current may flow through dual-drain conductors 416*a*, 416*b*. The current through dual-drain conductors 416*a*, 416*b* may avoid the periodic impedance discontinuity of the shield, and thereby may reduce the occurrence of undesired resonance. Unlike conventional dual-drain cables, the cable size (e.g., width) may not be appreciably increased by the presence of dual-drain conductors 416*a*, 416*b*. Conventional dual-drain cables typically have a width that is directly increased by the diameter of their two drain wires. By contrast, the diameters of the first and second wires 400*a*, 400*b* may not appreciably increase in the presence of first and second drain conductors 416*a*, 416*b*. Drain alignment grooves 406*a*, 406*b* may provide physical support to first and second drain conductors 416*a*, 416*b* by allowing sizing of drain conductors 416*a*, 416*b* according to an amount of required electrical conductivity. Thus supported, the size of first and second drain conductors 416*a*, 416*b* may be appreciably reduced compared to conventional approaches, enabling use in applications that require smaller width cables.

Figure 5:
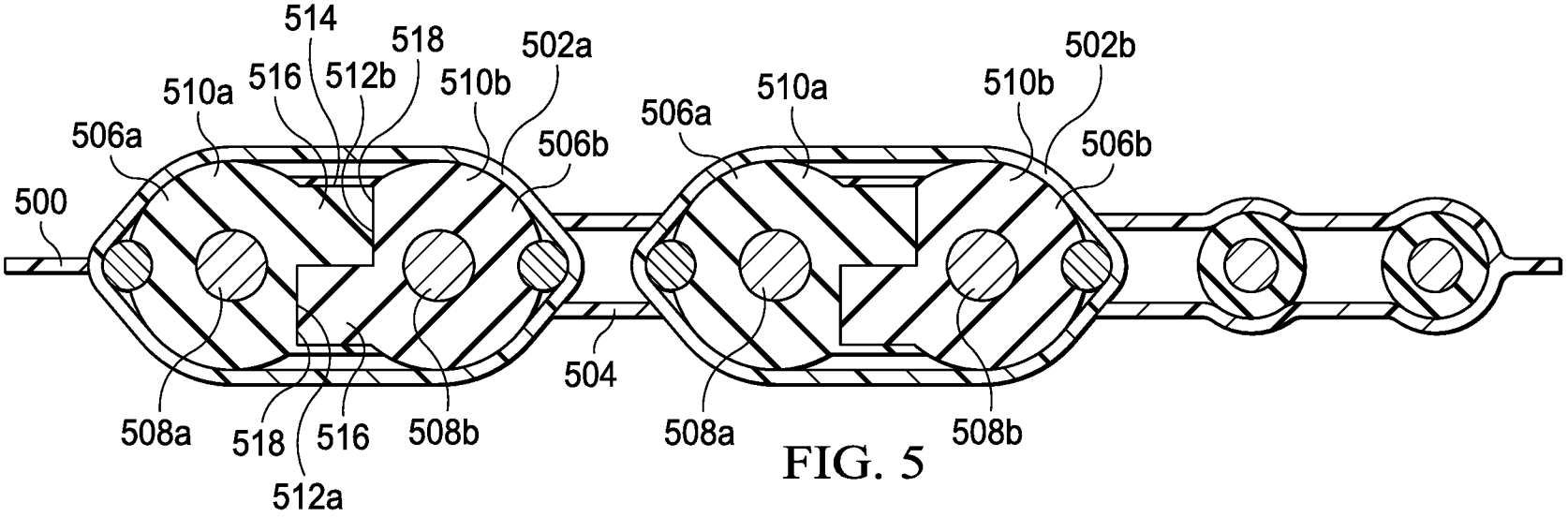
FIG. 5 illustrates a cross-section view an example ribbon cable formed from two dual-drain cables attached in parallel alignment by a ribbon substrate, in accordance with embodiments of the present disclosure.

FIG. 5 illustrates a cross-section view an example ribbon cable 500 formed from two dual-drain cables 502*a*, 502*b*, attached in parallel alignment by a ribbon substrate 504, in accordance with embodiments of the present disclosure. As shown in FIG. 4, each dual-drain cable 502*a*, 502*b* may include example first and second wires 506*a*, 506*b* that are correspondingly formed with electrical conductors 508*a*, 508*b* surrounded by respective first and second electrical insulators 510*a*, 510*b*, similar to that shown in FIGS. 4A-4D and discussed above. First and second electrical insulators 510*a*, 510*b* may have respective first and second inward sides 512*a*, 512*b*, interlocking structure 514 that includes correspondingly sized male and female interlocking surfaces 516, 518 on respective sides about a midpoint, also similar to that shown in FIGS. 4A-4D and discussed above.

Figure 6:
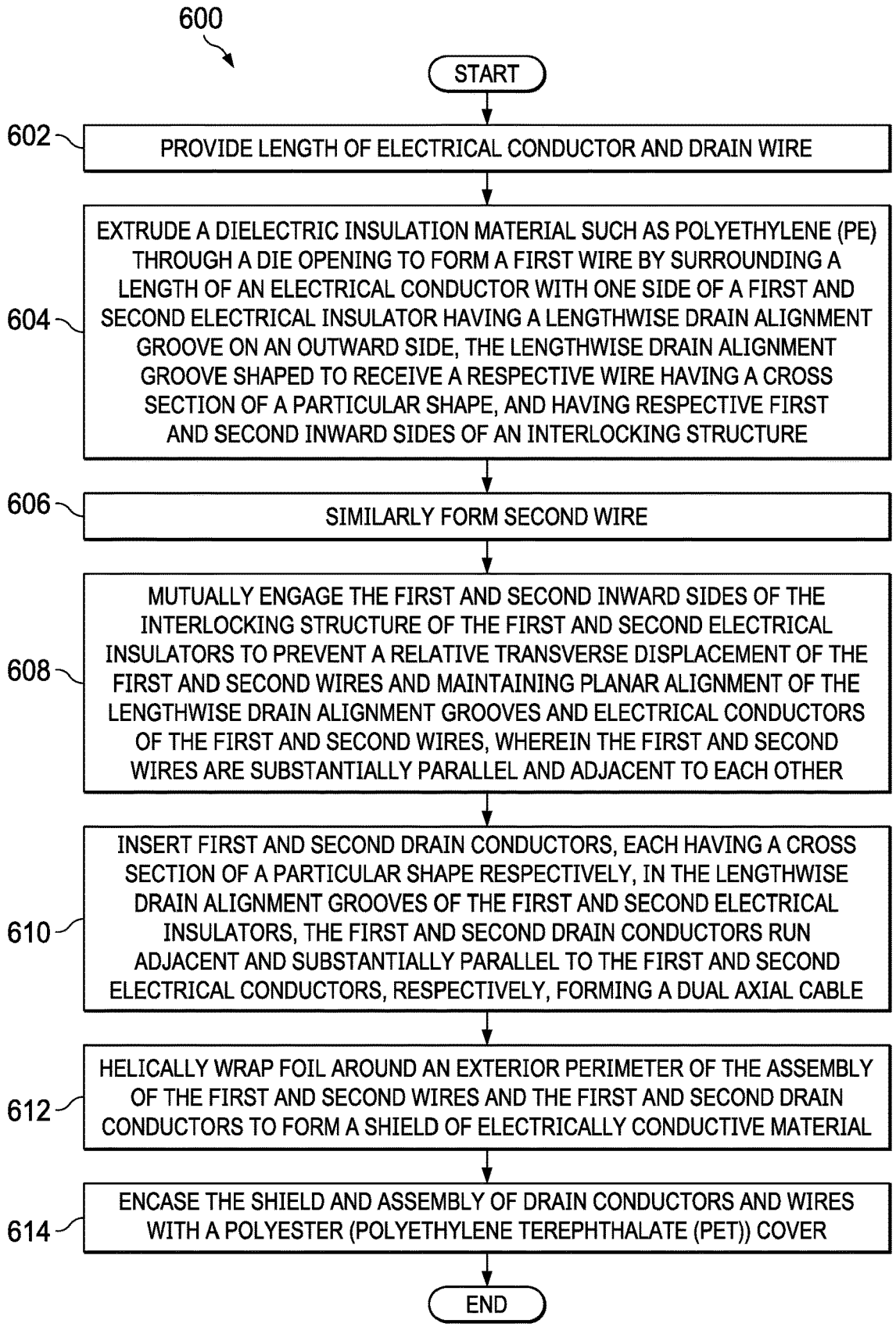
FIG. 6 illustrates a flow chart of an example method for forming a dual-drain, dual-axial cable that maintains planar alignment during shield wrapping to ensure high communication performance, in accordance with embodiments of the present disclosure.

FIG. 6 illustrates a flow chart of an example method 600 for forming a dual-drain, dual-axial cable that maintains planar alignment during shield wrapping to ensure high communication performance, in accordance with embodiments of the present disclosure. According to some embodiments, method 600 may begin at step 602. As noted above, teachings of the present disclosure may be implemented in a variety of configurations of information handling system 100. As such, the preferred initialization point for method 600 and the order of the steps comprising method 600 may depend on the implementation chosen.

At step 602, lengths of electrical conductor and drain wire may be provided. At step 604, method 600 may include extruding a dielectric insulation material, such as polyethylene (PE), through a die opening to form a first wire of PE surrounding a length of an electrical conductor. The die may impart a selected one of a first or second electrical insulator with a lengthwise drain alignment groove sized and shaped to receive a drain wire of rectangular cross section on an outward side and one side of first or second inward sides of an interlocking structure. At step 606, method 600 may include similarly forming the second wire in a manner similar to that of step 604.

At step 608, method 600 may include mutually engaging the first and second inward sides of the interlocking structure of the first and second electrical insulators to prevent a relative transverse displacement of the first and second wires. Engaging the interlocking structure may maintain planar alignment of the lengthwise drain alignment grooves and electrical conductors of the first and second wires. The first and second wires may be adjacent and substantially parallel to each other. In some embodiments, the first and second inward sides of the interlocking structure of the first and second electrical insulators may comprise corresponding male and female interlocking surfaces. In these and other embodiments, the first and second electrical insulators may be identical with the first and second inward sides of the interlocking structure comprising symmetric male and female features.

At step 610, method 600 may include inserting first and second drain conductors having a rectangular cross section respectively in the lengthwise drain alignment grooves of the first and second electrical insulators. The first and second drain conductors may run adjacent and substantially parallel to the first and second electrical conductors, respectively, forming a dual-axial cable.

At step 612, method 600 may include helically wrapping foil around an exterior perimeter of the assembly of the first and second wires and the first and second drain conductors to form a shield of electrically conductive material. At step 614, method 600 may include encasing the shield and assembly of drain conductors and wires with a polyester (polyethylene terephthalate (PET)) cover. After completion of step 614, method 600 may end.

In some embodiments, method 600 may include making another dual-axial cable. In these and other embodiments, method 600 may include attaching the dual-axial cable to the other axial cable with a ribbon substrate that maintains planar alignment of the lengthwise drain alignment grooves and electrical conductors of the first and second wires of the dual-axial cables.

Although FIG. 6 discloses a particular number of steps to be taken with respect to method 600, method 600 may be executed with greater or fewer steps than those depicted in FIG. 6. In addition, although FIG. 6 discloses a certain order of steps to be taken with respect to method 600, the steps comprising method 600 may be completed in any suitable order. In some implementations, certain steps of method 600 may be combined, performed simultaneously, performed in a different order, or perhaps omitted, without deviating from the scope of the disclosure.

Method 600 may be implemented using automated manufacturing system 144 and/or any other system operable to implement method 600. In certain embodiments, method 600 may be implemented partially in software and/or firmware embodied in computer-readable media.

Figure 7A:
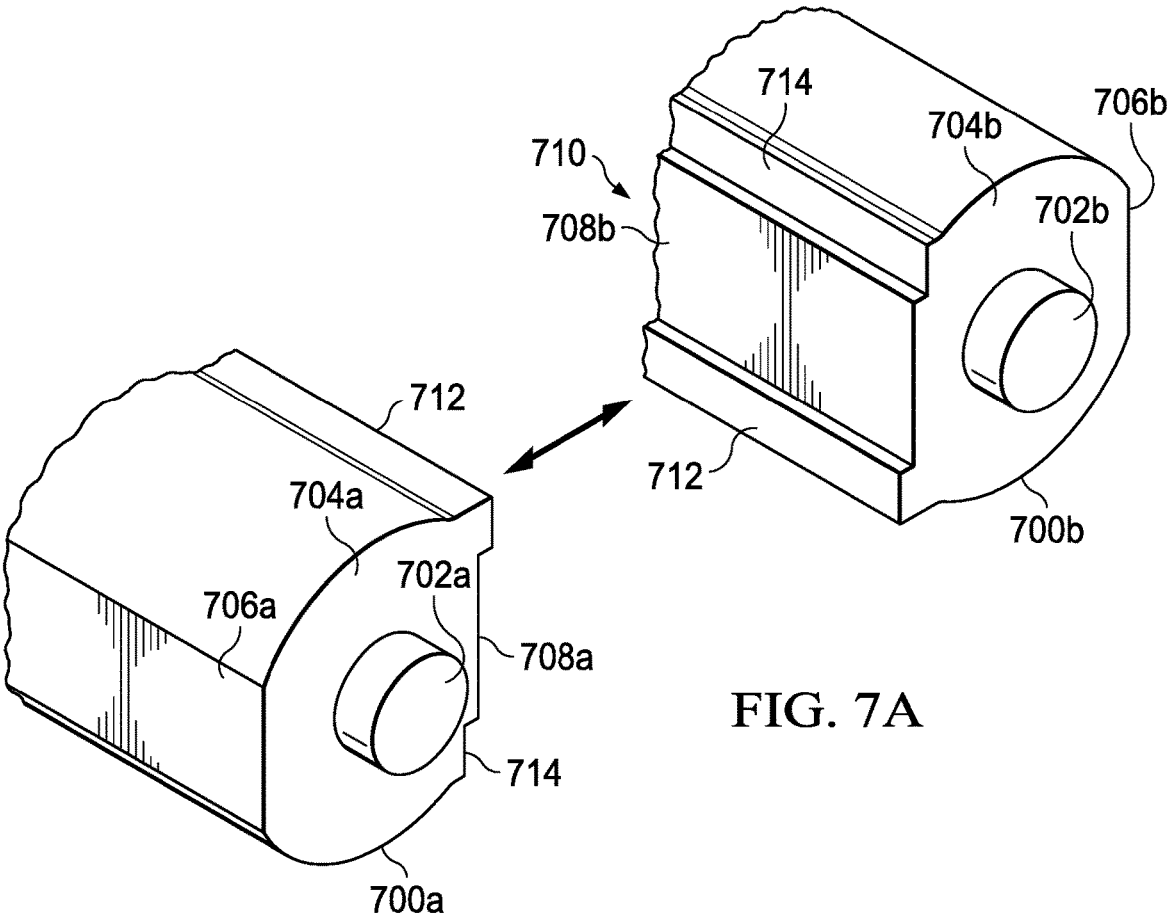
FIG. 7A illustrates a left-side perspective view illustrating example first and second wires of a dual-axial cable which are disassembled and identically formed, in accordance with embodiments of the present disclosure.
Figure 7B:
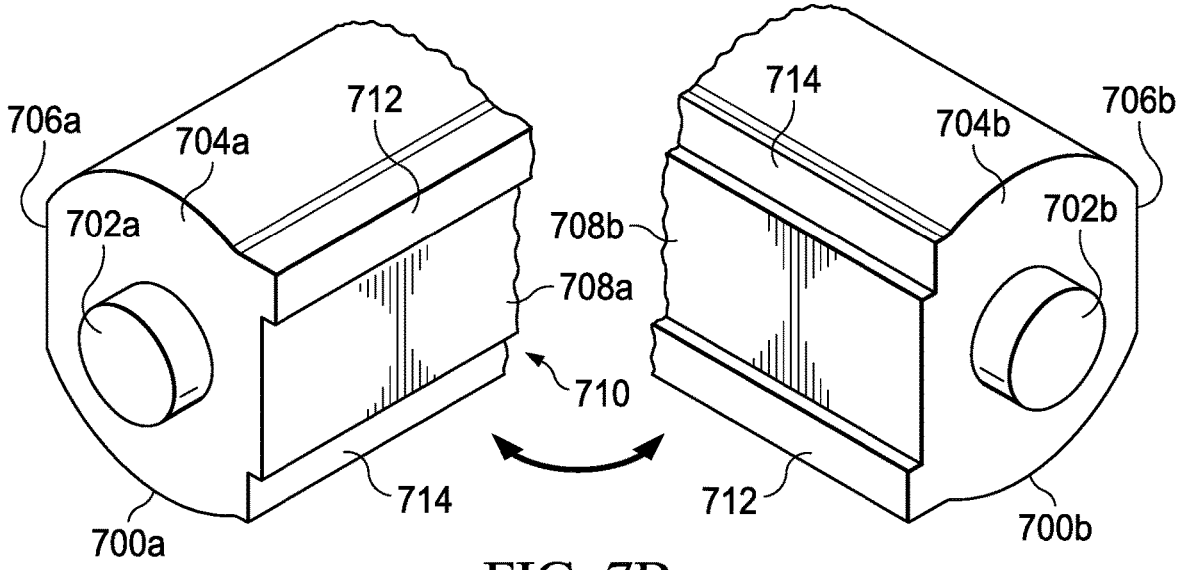
FIG. 7B illustrates a center perspective view illustrating the example first and second wires shown in FIG. 7A, in accordance with embodiments of the present disclosure.
Figure 7C:
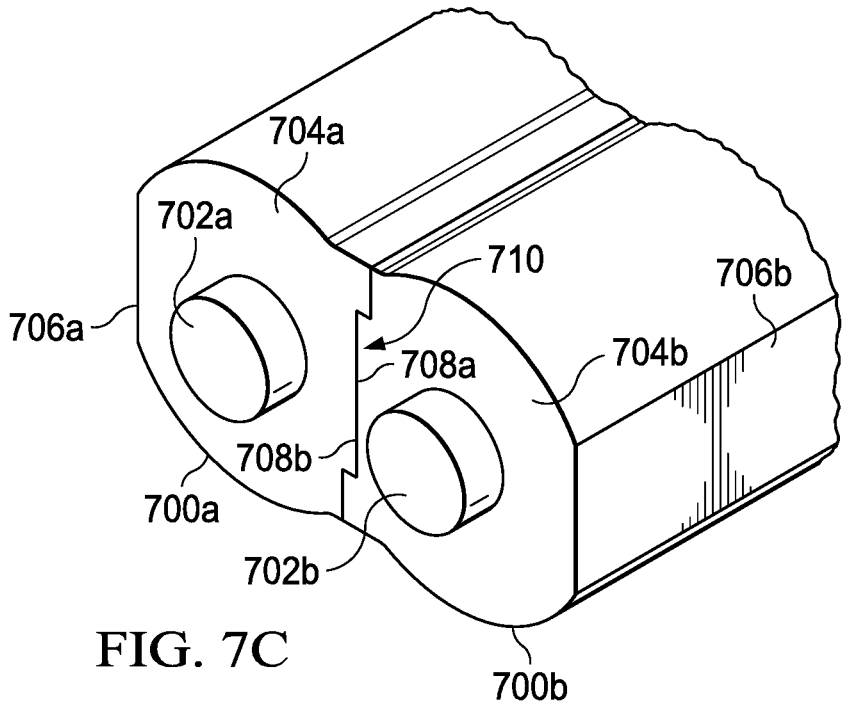
FIG. 7C illustrates a right-side perspective view illustrating the example first and second wires shown in FIGS. 7A and 7B interlocked, in accordance with embodiments of the present disclosure.
Figure 7D:
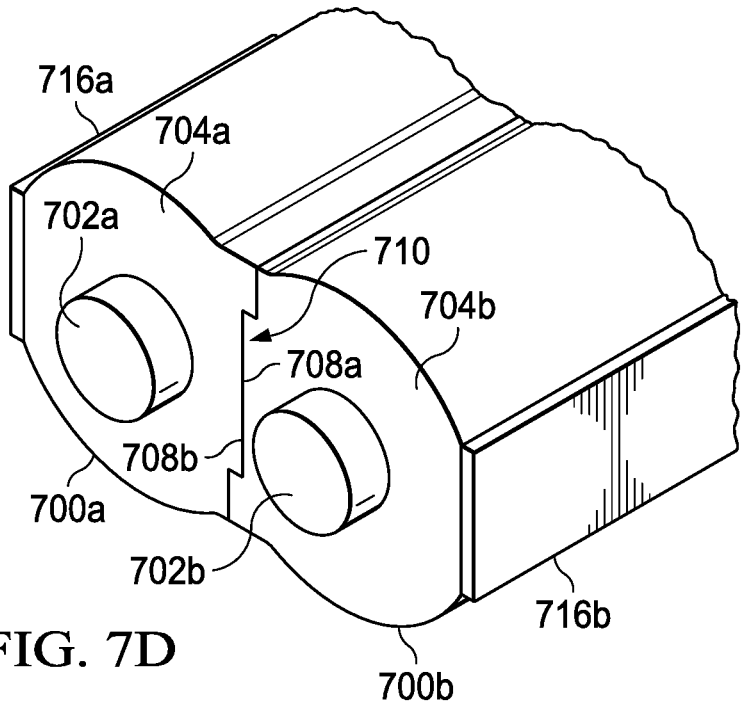
FIG. 7D illustrates a right-side perspective view illustrating the example first and second wires shown in FIG. 7C with plated drain conductors, in accordance with embodiments of the present disclosure.

FIG. 7A illustrates a left-side perspective view illustrating example first and second wires 700*a*, 700*b* of a dual-axial cable which are disassembled and identically formed, in accordance with embodiments of the present disclosure, while FIG. 7B illustrates a center perspective view illustrating the example first and second wires 700*a*, 700*b* shown in FIG. 7A, in accordance with embodiments of the present disclosure. FIG. 7C illustrates a right-side perspective view illustrating example first and second wires 700*a*, 700*b* interlocked, in accordance with embodiments of the present disclosure, while FIG. 7D illustrates a right-side perspective view illustrating example first and second wires 700*a*, 700*b* shown in FIG. 7C with plated drain conductors 716*a*, 716*b*, in accordance with embodiments of the present disclosure.

First and second wires 700*a*, 700*b* and the dual-axial, dual-drain cable formed therefrom may be similar in many respects to first and second wires 400*a*, 400*b*, and thus, only the material differences between first and second wires 700*a*, 700*b* on the one hand and first and second wires 400*a*, 400*b* on the other hand may be described below.

Most notably, first and second wires 700*a*, 700*b* do not include lengthwise drain alignment grooves 406*a*, 406*b* on an outward side of first and second wires 700*a*, 700*b*, nor do they include lengthwise drain conductors 416*a*, 416*b*. Instead, the outward side of each of first and second wires 700*a*, 700*b* may include respective flat faces 706*a*, 706*b*, such that flat faces 706*a*, 706*b* are generally parallel to one another when first and second wires 700*a*, 700*b* are assembled together. In addition, flat faces 706*a*, 706*b* may have conductive material plated thereon to form respective thin lengthwise drain conductors 716*a*, 716*b* running the respective lengths of flat faces 706*a*, 706*b*.

Thus, interlocking structure 410 may maintain planar alignment of flat faces 706*a*, 706*b*, and electrical conductors 402*a*, 402*b* of the first and second wires 400*a*, 400*b*. As shown in FIG. 7D, first and second drain conductors 716*a*, 716*b* may be adjacent and substantially parallel to first and second wires 700*a*, 700*b* and may be plated upon respective flat faces 706*a*, 706*b*.

In the construction illustrated by FIG. 7D, while some return current may flow on a shield (e.g., shield 166 shown in FIG. 1A), the largest portion of such return current may flow through dual-drain conductors 716*a*, 716*b*. The current through dual-drain conductors 716*a*, 716*b* may avoid the periodic impedance discontinuity of the shield, and thereby may reduce the occurrence of undesired resonance. Unlike conventional dual-drain cables, the cable size (e.g., width) may not be appreciably increased by the presence of dual-drain conductors 716*a*, 716*b*. Conventional dual-drain cables typically have a width that is directly increased by the diameter of their two drain wires. By contrast, the diameters of first and second wires 700*a*, 700*b* may not appreciably increase in the presence of first and second drain conductors 716*a*, 716*b*. Thus arranged, the size of first and second drain conductors 716*a*, 716*b* may be appreciably reduced compared to conventional approaches, enabling use in applications that require smaller width cables.

Figure 8:
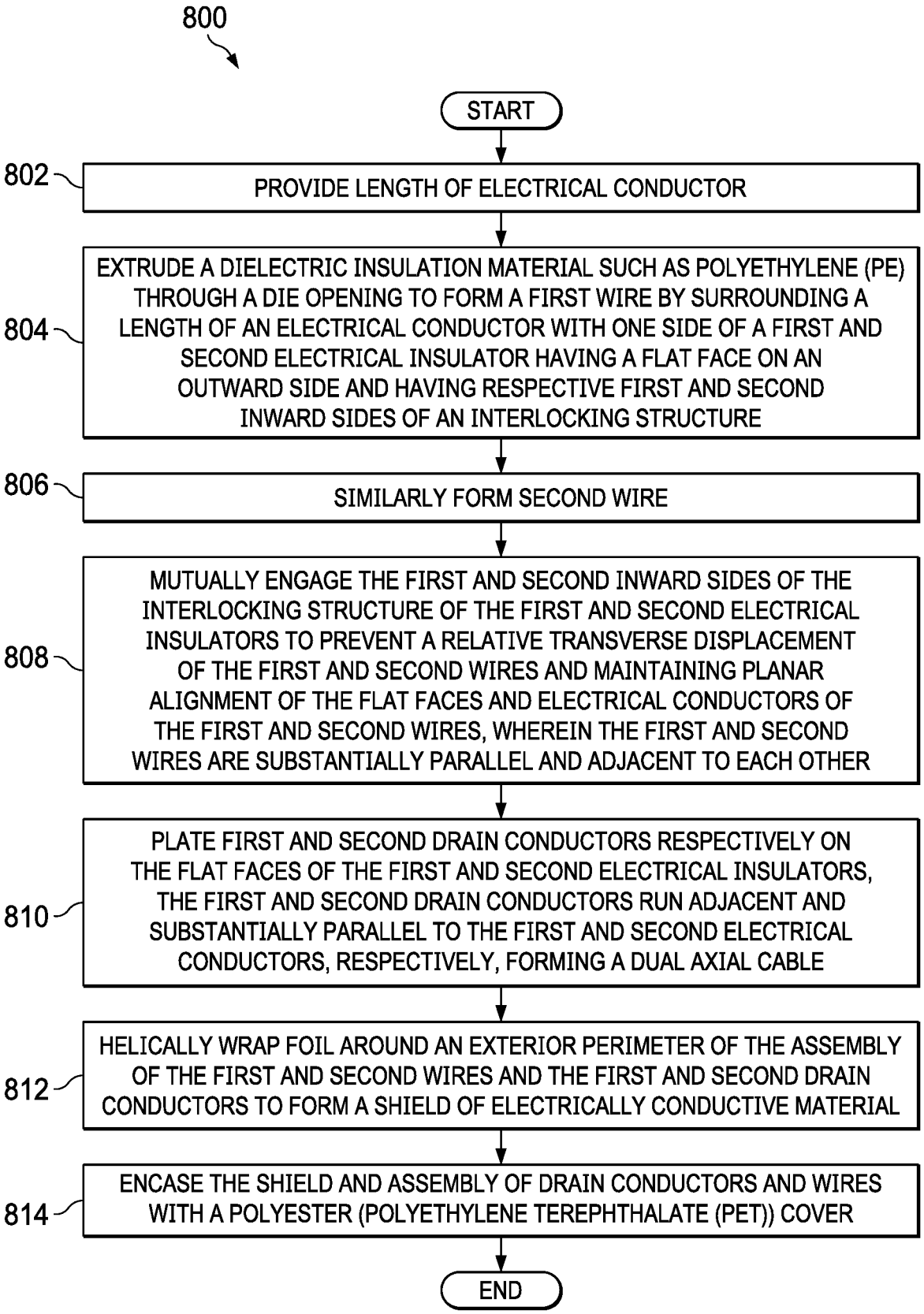
FIG. 8 illustrates a flow chart of an example method for forming a dual-drain, dual-axial cable having plated drain conductors to ensure high communication performance, in accordance with embodiments of the present disclosure.

FIG. 8 illustrates a flow chart of an example method 800 for forming a dual-drain, dual-axial cable that maintains planar alignment during shield wrapping to ensure high communication performance, in accordance with embodiments of the present disclosure. According to some embodiments, method 800 may begin at step 802. As noted above, teachings of the present disclosure may be implemented in a variety of configurations of information handling system 100. As such, the preferred initialization point for method 800 and the order of the steps comprising method 800 may depend on the implementation chosen.

At step 802, lengths of electrical conductor and drain wire may be provided. At step 804, method 800 may include extruding a dielectric insulation material, such as polyethylene (PE), through a die opening to form a first wire of PE surrounding a length of an electrical conductor. The die may impart a selected one of a first or second electrical insulator with a flat face on an outward side and one side of the first or second inward sides of an interlocking structure. At step 806, method 800 may include similarly forming the second wire in a manner similar to that of step 804.

At step 808, method 800 may include mutually engaging the first and second inward sides of the interlocking structure of the first and second electrical insulators to prevent a relative transverse displacement of the first and second wires. Engaging the interlocking structure may maintain planar alignment of the flat faces and electrical conductors of the first and second wires. The first and second wires may be adjacent and substantially parallel to each other. In some embodiments, the first and second inward sides of the interlocking structure of the first and second electrical insulators may comprise corresponding male and female interlocking surfaces. In these and other embodiments, the first and second electrical insulators may be identical, with the first and second inward sides of the interlocking structure comprising symmetric male and female features.

At step 810, method 800 may include plating first and second drain conductors on the flat faces of the first and second electrical insulators. The first and second drain conductors may run adjacent and substantially parallel to the first and second electrical conductors, respectively, forming a dual-axial cable.

At step 812, method 800 may include helically wrapping foil around an exterior perimeter of the assembly of the first and second wires and the first and second drain conductors to form a shield of electrically conductive material. At step 814, method 800 may include encasing the shield and assembly of drain conductors and wires with a polyester (polyethylene terephthalate (PET)) cover. After completion of step 814, method 800 may end.

In some embodiments, method 800 may include making another dual-axial cable. In these and other embodiments, method 800 may include attaching the dual-axial cable to the other axial cable with a ribbon substrate that maintains planar alignment of the drain conductors and electrical conductors of the first and second wires of the dual-axial cables.

Although FIG. 8 discloses a particular number of steps to be taken with respect to method 800, method 800 may be executed with greater or fewer steps than those depicted in FIG. 8. In addition, although FIG. 8 discloses a certain order of steps to be taken with respect to method 800, the steps comprising method 800 may be completed in any suitable order. In some implementations, certain steps of method 800 may be combined, performed simultaneously, performed in a different order, or perhaps omitted, without deviating from the scope of the disclosure.

Method 800 may be implemented using automated manufacturing system 144 and/or any other system operable to implement method 800. In certain embodiments, method 800 may be implemented partially in software and/or firmware embodied in computer-readable media.

Figure 9:
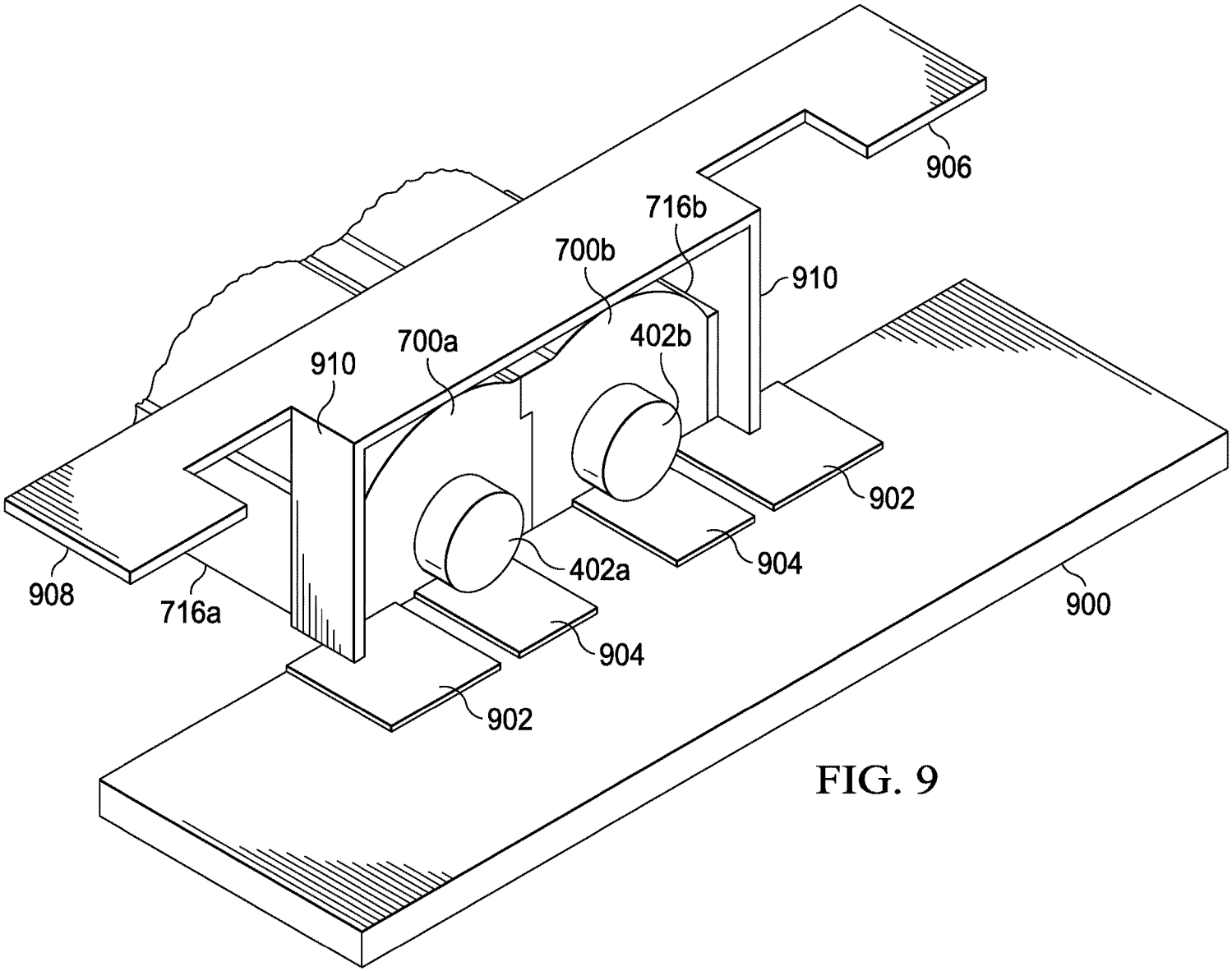
FIG. 9 illustrates a perspective view of a dual-drain, dual-axial cable having plated drain conductors mounted to a PCB via a grounding bar, in accordance with embodiments of the present disclosure.

FIG. 9 illustrates a perspective view of a dual-drain, dual-axial cable having wires 700*a*, 700*b* with plated drain conductors 716*a*, 716*b* mounted to a PCB 900 via a grounding bar 906, in accordance with embodiments of the present disclosure.

As shown in FIG. 9, PCB 900 may include a plurality of ground pads 902 and a plurality of signal pads 904 each made of electrically-conductive material formed on a surface of PCB 900. Grounding bar 906 may be made of electrically-conductive material and may include a crossbar 908 oriented parallel to the surface of PCB 900 with a plurality of flanges 910 extending perpendicularly from crossbar 908 as shown in FIG. 9. Also as shown in FIG. 9, ends of flanges 910 may be soldered to grounding pads 902 and soldered to drain conductors 716*a*, 716*b* such that drain conductors 716*a*, 716*b* are parallel to flanges 910. As so constructed, grounding bar 906 may ground drain conductors 716*a*, 716*b* as well as apply mechanical forces to mate electrical conductors 402*a*, 402*b* of wires 700*a*, 700*b* to respective signal pads 904 and apply mechanical forces to maintain the dual-axial, dual-drain cable in place.

Figure 10:
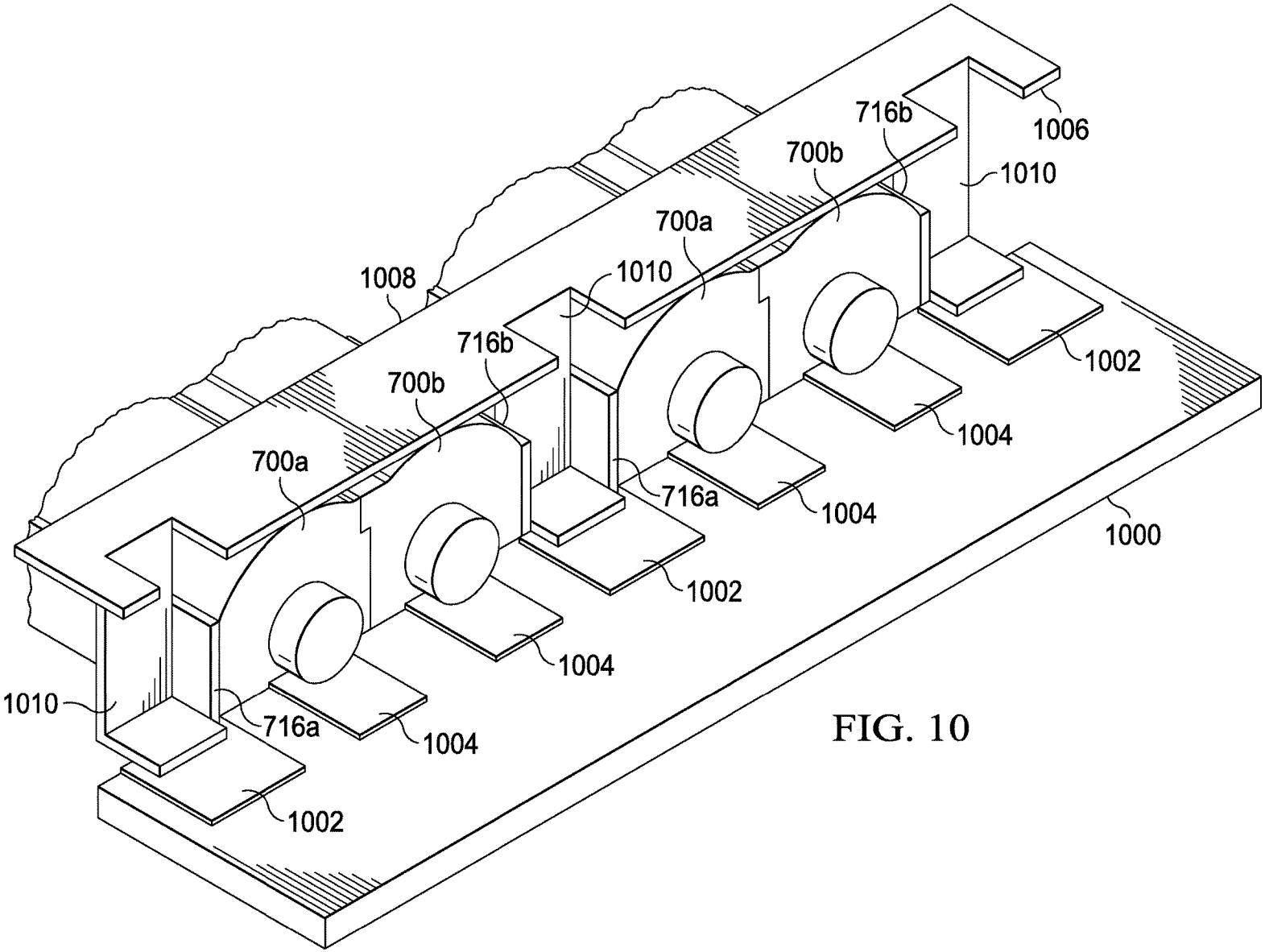
FIG. 10 illustrates a perspective view of dual-drain, dual-axial cables having plated drain conductors mounted to a PCB via a grounding bar, in accordance with embodiments of the present disclosure.

FIG. 10 illustrates a perspective view of dual-drain, dual-axial cables wires 700*a*, 700*b* with plated drain conductors 716*a*, 716*b* mounted to a PCB 1000 via a grounding bar 1006, in accordance with embodiments of the present disclosure.

As shown in FIG. 10, PCB 1000 may include a plurality of ground pads 1002 and a plurality of signal pads 1004 each made of electrically-conductive material formed on a surface of PCB 1000. Grounding bar 1006 may be made of electrically-conductive material and may include a crossbar 1008 oriented parallel to the surface of PCB 1000 with a plurality of flanges 1010 extending perpendicularly from crossbar 1008 as shown in FIG. 10. Also as shown in FIG. 10, ends of flanges 1010 may be soldered to grounding pads 1002 and soldered to drain conductors 716*a*, 716*b* such that drain conductors 716*a*, 716*b* are perpendicular to flanges 1010. As so constructed, grounding bar 1006 may ground drain conductors 716*a*, 716*b* as well as apply mechanical forces to mate electrical conductors 402*a*, 402*b* of wires 700*a*, 700*b* to respective signal pads 1004 and apply mechanical forces to maintain the dual-axial, dual-drain cables in place. As shown in FIG. 10, flanges 1010 may be formed such that each flange 1010 is capable of being soldered to drain conductors of adjacent dual-axial, dual-drain cables, thus requiring a small footprint as compared to grounding bar 906.

As used herein, when two or more elements are referred to as "coupled" to one another, such term indicates that such two or more elements are in electronic communication or mechanical communication, as applicable, whether connected indirectly or directly, with or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative. Accordingly, modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

Although exemplary embodiments are illustrated in the figures and described above, the principles of the present disclosure may be implemented using any number of techniques, whether currently known or not. The present disclosure should in no way be limited to the exemplary implementations and techniques illustrated in the figures and described above.

Unless otherwise specifically noted, articles depicted in the figures are not necessarily drawn to scale.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

Although specific advantages have been enumerated above, various embodiments may include some, none, or all of the enumerated advantages. Additionally, other technical advantages may become readily apparent to one of ordinary skill in the art after review of the foregoing figures and description.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

What is claimed is:

1. A dual-axial cable comprising:

adjacent and substantially parallel first and second wires, each wire formed from an electrical conductor surrounded by a respective first and second electrical insulator having a lengthwise drain alignment groove on an outward side and having respective first and second inward sides of an interlocking structure, the first and second inward sides of the interlocking structure of the first and second electrical insulators mutually engaging to prevent a relative transverse displacement of the first and second wires and maintaining planar alignment of the lengthwise drain alignment grooves and electrical conductors of the first and second wires; and first and second drain conductors received respectively in the lengthwise drain alignment grooves of the first and second electrical insulators and running adjacent and substantially parallel to the first and second electrical conductors;

wherein the lengthwise drain alignment grooves are sized and shaped to have three sides configured to retain the first and second drain conductors.

2. The dual-axial cable of claim 1, wherein the first and second inward sides of the interlocking structure of the first and second electrical insulators comprise corresponding male and female interlocking surfaces.

3. The dual-axial cable of claim 1, wherein the first and second electrical insulators are identical, with the first and second inward sides of the interlocking structure comprising symmetric male and female features.

4. The dual-axial cable of claim 1, further comprising a shield of electrically conductive material surrounding an assembly of the first and second wires and the first and second drain conductors.

5. The dual-axial cable of claim 4, wherein the shield comprises foil helically wrapped around an exterior perimeter of the assembly of the first and second wires and the first and second drain conductors.

6. A method comprising:

forming first and second wires respectively by surrounding a length of an electrical conductor with a respective one of a first and second electrical insulator having a lengthwise drain alignment groove on an outward side and having respective first and second inward sides of an interlocking structure;

mutually engaging the first and second inward sides of the interlocking structure of the first and second electrical insulators to prevent a relative transverse displacement of the first and second wires and maintaining planar alignment of the lengthwise drain alignment grooves and electrical conductors of the first and second wires, wherein the first and second wires are adjacent and substantially parallel to each other; and inserting first and second drain conductors respectively in the lengthwise drain alignment grooves of the first and second electrical insulators, the first and second drain conductors running adjacent and substantially parallel to the first and second electrical conductors, respectively, forming a dual-axial cable;

wherein the lengthwise drain alignment grooves are sized and shaped to have three sides configured to retain the first and second drain conductors.

7. The method of claim 6, wherein the first and second inward sides of the interlocking structure of the first and second electrical insulators comprise corresponding male and female interlocking surfaces.

8. The method of claim 6, wherein the first and second electrical insulators are identical with the first and second inward sides of the interlocking structure comprising symmetric male and female features.

9. The method of claim 6, further comprising surrounding an assembly of the first and second wires and the first and second drain conductors with a shield of electrically conductive material.

10. The method of claim 9, wherein surrounding the first and second wires and the first and second drain conductors with the shield of electrically conductive material comprises helically wrapping foil around an exterior perimeter of the assembly of the first and second wires and the first and second drain conductors.

11. The method of claim 6, further comprising:

making another dual-axial cable; and attaching the dual-axial cable to the other axial cable with a ribbon substrate that maintains planar alignment of the lengthwise drain alignment grooves and electrical conductors of the first and second wires of the dual-axial cables.

12. The method of claim 6, wherein surrounding the length of the electrical conductor with the electrical insulator comprises extruding a dielectric insulation material through a die opening that imparts the outer drain alignment groove and one inward side of the interlocking structure.

13. A dual-axial cable comprising:

adjacent and substantially parallel first and second wires, each wire formed from an electrical conductor surrounded by a respective first and second electrical insulator having a lengthwise flat face outward side and having respective first and second inward sides of an interlocking structure, the first and second inward sides of the interlocking structure of the first and second electrical insulators mutually engaging to prevent a relative transverse displacement of the first and second wires and maintaining planar alignment of the flat face and electrical conductor of the first and second wires and to maintain the flat faces parallel to one another; and first and second drain conductors formed respectively on the flat faces of the first and second electrical insulators and running adjacent and substantially parallel to the first and second electrical conductors.

14. The dual-axial cable of claim 13, wherein the first and second inward sides of the interlocking structure of the first and second electrical insulators comprise corresponding male and female interlocking surfaces.

15. The dual-axial cable of claim 13, wherein the first and second electrical insulators are identical, with the first and second inward sides of the interlocking structure comprising symmetric male and female features.

16. The dual-axial cable of claim 13, further comprising a shield of electrically conductive material surrounding an assembly of the first and second wires and the first and second drain conductors.

17. The dual-axial cable of claim 16, wherein the shield comprises foil helically wrapped around an exterior perimeter of the assembly of the first and second wires and the first and second drain conductors.

18. A method comprising:

forming first and second wires respectively by surrounding a length of an electrical conductor with a respective one of a first and second electrical insulator having a flat face on an outward side and having respective first and second inward sides of an interlocking structure;

mutually engaging the first and second inward sides of the interlocking structure of the first and second electrical insulators to prevent a relative transverse displacement of the first and second wires and maintaining planar alignment of the flat faces and electrical conductors of the first and second wires and to maintain the flat faces parallel to one another, wherein the first and second wires are adjacent and substantially parallel to each other; and forming first and second drain conductors respectively on the flat faces of the first and second electrical insulators, the first and second drain conductors running adjacent and substantially parallel to the first and second electrical conductors, respectively, forming a dual-axial cable.

19. The method of claim 18, wherein the first and second inward sides of the interlocking structure of the first and second electrical insulators comprise corresponding male and female interlocking surfaces.

20. The method of claim 18, wherein the first and second electrical insulators are identical with the first and second inward sides of the interlocking structure comprising symmetric male and female features.

21. The method of claim 18, further comprising surrounding an assembly of the first and second wires and the first and second drain conductors with a shield of electrically conductive material.

22. The method of claim 21, wherein surrounding the first and second wires and the first and second drain conductors with the shield of electrically conductive material comprises helically wrapping foil around an exterior perimeter of the assembly of the first and second wires and the first and second drain conductors.

23. The method of claim 18, wherein forming first and second drain conductors respectively on the flat faces of the first and second electrical insulators comprises plating electrically conductive material on the flat faces.

* * * * *